US006779457B2

(12) United States Patent
Kutzli et al.

(10) Patent No.: US 6,779,457 B2
(45) Date of Patent: Aug. 24, 2004

(54) PERCUSSION FUSE (IGNITION DEVICE)

(75) Inventors: Jörg Kutzli, Höfen (CH); Pascal Guenot, Les Brenets (CH)

(73) Assignee: Ruag Munition, Thun (CH)

( * ) Notice: Subject to any disclaimer, the term of this patent is extended or adjusted under 35 U.S.C. 154(b) by 0 days.

(21) Appl. No.: 10/393,471

(22) Filed: Mar. 20, 2003

(65) Prior Publication Data

US 2004/0020395 A1 Feb. 5, 2004

Related U.S. Application Data

(60) Provisional application No. 60/381,612, filed on May 17, 2002.

(51) Int. Cl.[7] ..... F42C 15/32

(52) U.S. Cl. ..... 102/223; 102/226; 102/227

(58) Field of Search ..... 102/223, 226, 102/227, 225

(56) References Cited

U.S. PATENT DOCUMENTS

| | | | | | |
|---|---|---|---|---|---|
| 3,611,943 | A | * | 10/1971 | Popper | 102/208 |
| 3,677,186 | A | * | 7/1972 | Munach | 102/225 |
| 3,710,716 | A | * | 1/1973 | Davis et al. | 102/397 |
| 3,710,722 | A | * | 1/1973 | Demas et al. | 102/226 |
| 3,735,707 | A | * | 5/1973 | Unfried et al. | 102/224 |
| 3,772,992 | A | * | 11/1973 | Moore et al. | 102/208 |
| 3,948,183 | A | * | 4/1976 | Fisher et al. | 102/207 |
| 3,960,086 | A | * | 6/1976 | Fisher | 102/208 |
| 4,637,311 | A | | 1/1987 | Rahmann | |
| 4,779,533 | A | * | 10/1988 | Winterhalter et al. | 102/270 |
| 4,964,341 | A | * | 10/1990 | Hebert | 102/501 |
| 5,686,686 | A | * | 11/1997 | Woodall et al. | 89/1.13 |
| 5,877,448 | A | * | 3/1999 | Denton et al. | 102/401 |
| 2001/0017090 | A1 | * | 8/2001 | Zehnder et al. | 102/223 |

FOREIGN PATENT DOCUMENTS

WO WO 00/31497 A1 6/2000

* cited by examiner

*Primary Examiner*—Charles T. Jordan
*Assistant Examiner*—Bret Hayes
(74) *Attorney, Agent, or Firm*—Schweitzer Cornman Gross & Bondell LLP

(57) ABSTRACT

A method and apparatus for protecting and arming fuses in a projectile to satisfy safety requirements and to initiate ignition with only minimal delay. In accordance with the method, after launch of a projectile, behind a cap having a central inlet opening a safety device of a turbine/ignition pin unit is released and the impeller thereof is subjected to ram pressure. The ram pressure displaces the turbine/ignition pin unit into a front position, to act as impact detector. In a device constructed in accordance with the invention, the turbine/ignition pin unit has a screw thread on its shank and is screwed into a threaded bushing so that the ram pressure displaces the unit, against the direction of flow into the front position. On impact, the rear end of the unit acts as a percussion needle and initiates an ignition chain.

14 Claims, 5 Drawing Sheets

II
III
M

IX
IX
II
M
1
1a
1b
1c
1d
2
3
6
6''
8
8a
9
10
11
12
14
17
18a
19
23
24
24a
25
26
27
32
38
43
44
46
47
48'
49
50
52
53
13b
L
L'
S

PERCUSSION FUSE (IGNITION DEVICE)

This application claims benefit of provisional application 60/381,612 filed May 17, 2002.

The present invention relates to a method and to a device for protecting and arming fuses in a projectile.

BACKGROUND OF THE INVENTION

Projectile fuses must satisfy high safety requirements and, in compliance with standards (such as STANAG 4187, MIL-STD-1316E), must include safety devices physically separated from one another. In their storage and transport state, they may not have any stored energy that could lead to premature ignition and/or to charging thereof or to partial release of safety devices. The necessary ignition energy is therefore made available only during launching; from WO 00/31497, inter alia, a mortar fuse having a wind-driven wheel is known, which drives a generator and charges up a battery that is chemically activated only during launching.

The disadvantage with such a system is the necessary storage of battery acid, which sets limits to the storage properties of the ignition system. The individual elements arranged at the front end, such as a wind-driven wheel, acid container, battery cells, generator and ignition electronics with timer, and special impact detectors, adversely affect system safety due to the interfaces and components required for signal transmission.

In projectiles, a shock resulting from launch (mechanical pulse) is used for safety device release, or as a preliminary stage to the armed setting. Cf.

EP-A1-0 156 763, (corresponding to U.S. Pat. No. 4,637,311) which has a high-energy electromagnetic ignition system. In the case of spin-stabilized projectiles, the spin build-up during launch can likewise be used for safety device release and as source of energy.

When employing projectiles, especially mortar grenades, it has repeatedly been demonstrated that conventional percussion fuses do not react quickly enough, that, for example, ignition is effected only after a distance to the target has already been covered, and that most commercially available fuses do not react at all on impact with soft targets. Both of these circumstances can lead to undesirable duds that are difficult to find. A delayed ignition can also reduce the effect at the target, since propagation of the shock waves of the active charge is disrupted or even partially shielded by the target itself.

The object of the present invention is therefore to produce an ignition method and an ignition device for projectile fuses that, high system safety and without complicated electrical and/or electronic features, reacts rapidly on impact and also responds to soft targets. The device should also function reliably even when the angle of impact is acute and on impact with water surfaces.

The device should also be adaptable within wide limits to existing ammunition bodies and be suitable both for mechanical fuses equipped with striking pins and for conventional electrical fuses.

BRIEF DESCRIPTIONS OF THE INVENTION

The foregoing and other objects are achieved by the features of the method of the present invention in which a striking or ignition pin is displaced relative to the projectile in a direction opposite to raw pressure from a first position into a second, armed position. Upon impact, the pin initiates ignition by rearward displacement to a third position.

A percussion fuse constructed in accordance with the invention can achieve response times of less than 250 ps and achieve optimum effect at a target even when used in a high-velocity projectile.

The term "striking pin" refers to constructions with a percussion fuse, while the term "ignition pin" relates to mechanically triggered electrical fuses. The ignition pin used in those ignition devices consequently has only an electrical switching function. In both variants, the construction of the striking pin and ignition pin respectively is similar; only the initiation of the ignition is, in a manner known per se, different.

In accordance with the invention, and viewed in the direction of launching, the striking pin or ignition pin is preferably located in a rear, protected position safeguarded against external influences and is displaced relative to the projectile by and opposite to the ram pressure acting on the head of the projectile during normal launching, forward into an armed setting.

This is especially advantageous as regards safe practice measures; if the projectile is accidentally dropped or improperly handled, ignition cannot be initiated since the ram pressure necessary for moving the striking pin or ignition pin is not present. In addition, long pin displacement paths can be achieved, which increases the overall safety of the system.

The ignition chain can therefore be constructed as desired and as conventionally known; likewise the supply thereof with ignition energy may be as generally known.

The use of ram pressure to displace the striking pin or ignition pin allows diverse structural options. For example, the dynamic pressure can be used pneumatically and/or hydraulically directly to reverse the direction of action thereof; gears and moving parts operable by the dynamic pressure are likewise possible for that purpose.

Mechanical conversion of a rotary movement into a linear movement is especially reliable and capable of being used at any time. By means of an impeller mounted on the striking pin or ignition pin, the latter experiences a rotary movement. If part of the striking pin or ignition pin is provided with an external thread and inserted in a threaded bushing (internal screw thread), after the ram pressure has acted on the impeller the pin will screw itself into the forward armed setting.

Advantageously, the impeller may be arranged behind a front-end central inlet opening and its hub and/or the leading end region of the striking pin or ignition pin matched to the inlet opening so that the forward end position of the impeller closes the inlet opening. Mechanical overload of the pin and/or of the threaded bushing can consequently be prevented and interference with the operating sequence can be avoided.

On impact of the projectile on the target, the impeller and the part containing the inlet opening act as actuating elements for the striking pin or ignition pin. Surface pressure occurring at impact even with soft ground or water is sufficient to displace the pin reliably into a third position initiating ignition. For this purpose, the fit of the threaded bush in its locating bore described as a so-called sliding fit has proved successful, the displacement path of the bush being mechanically limited in the direction of launching.

By means of a double-mass catch known per se, release of a rotor determining safety after a projectile has left a gun barrel can be adapted to the launching characteristic of the projectile and this can be monitored.

A further arming mass, which is subjected to the launch acceleration, is able, in the course of its displacement, to turn a tensioning shaft and hence exert a torque on the rotor by way of a spring connected therewith.

By means of an additional locking part located on the arming mass, the impeller of the turbine can move forward and at the instant of launching effects positive blocking.

It has proved especially worthwhile to safeguard the ignition device by a protective cap, which engages in the manner of a bayonet closure in a rotatable front part. By means of an additional release lug, rotation of the front part can be used to operate a further arming mass catch.

Especially reliable is the engagement of the catch in the displacement path of the arming mass, which generates the spring tension required for rotation of the rotor. In practice, this means that even on a dive from great height, no torque is exerted on the rotor.

Pivoting of the rotor about an angle at center of 120° required for complete arming, and hence for ignition, ensures maximum safety, and this notwithstanding a compact construction of the ignition device.

A spring-loaded ball that acts on the threaded bushing of the turbine/ignition pin unit enables the resistance to displacement to be adjusted so that neither heavy rain nor snow nor hail can cause premature initiation of ignition.

BRIEF DESCRIPTIONS OF THE INVENTION

With reference to exemplary embodiments, the method and the ignition device of the invention in conjunction with a percussion fuse, fitted into an ammunition body, are explained in detail in the following description and in the accompanying drawings, in which.

DETAILED DESCRIPTION OF THE INVENTION

Figures 1, 2, 3:
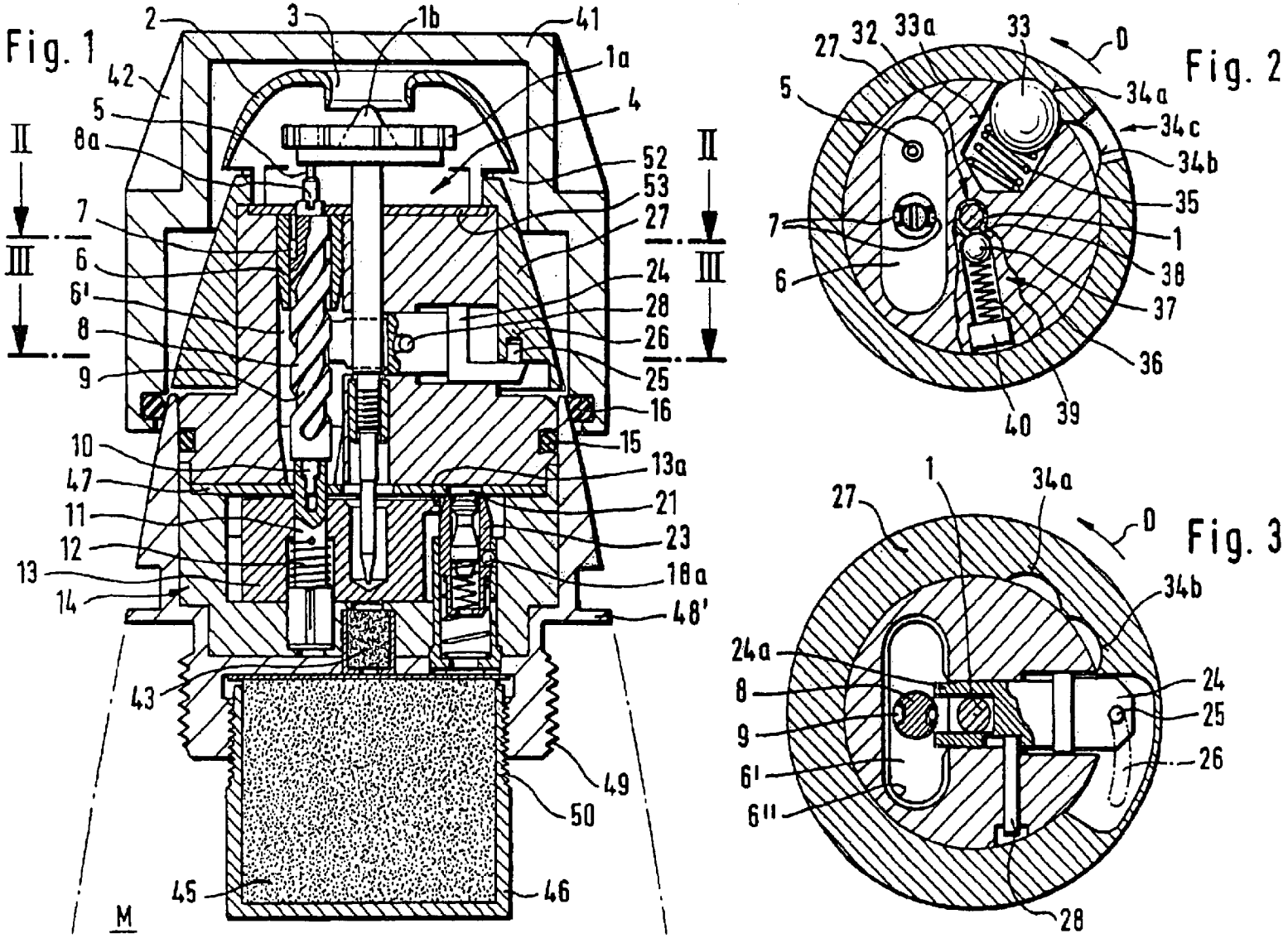
FIG. 1 shows a sectional view of a ignition device of the invention with a safety catch on, the ignition device having been screwed into an ammunition body and being covered by a protective cap.
FIG. 2 is a sectional view through the plane of section II—II of FIG. 1, with the protective cap removed, the plane of section being partially broken away to reveal a plane beneath.
FIG. 3 is a view analogous to FIG. 2 though the plane of section III—III in FIG. 1.
Figure 4:
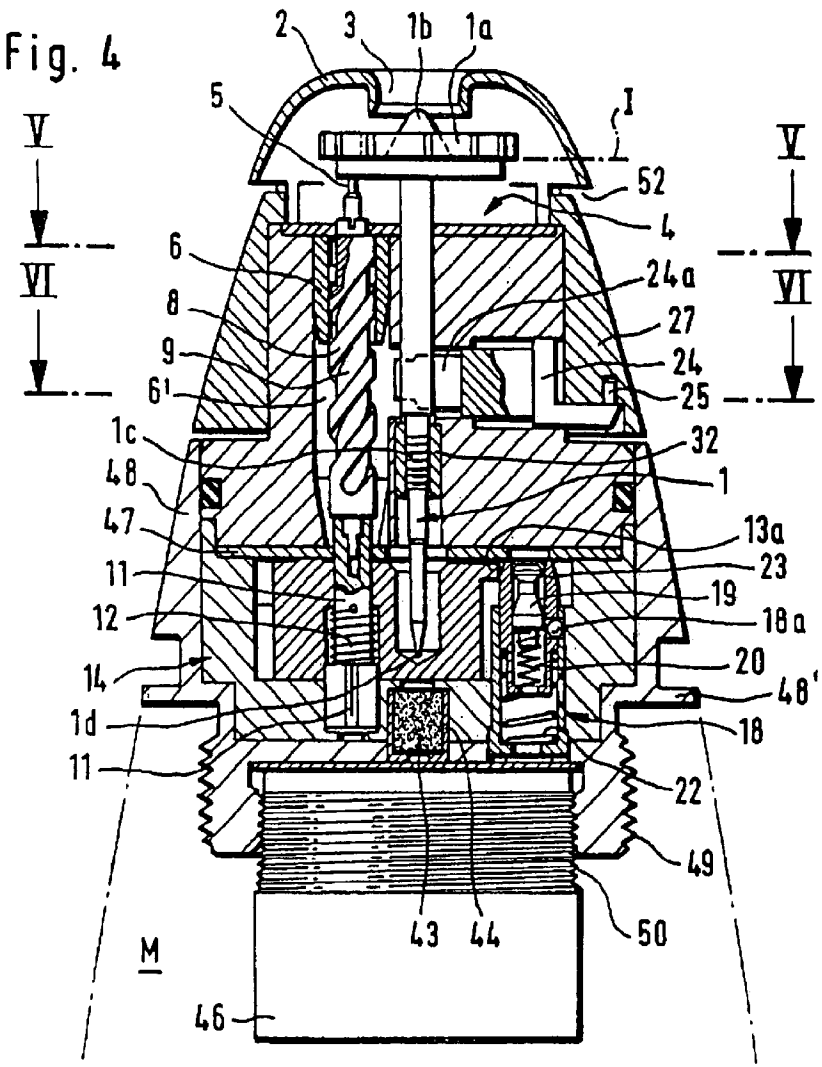
FIG. 4 shows the ignition device of FIG. 1 in an unlocked position prior to launching.

The principle of the subject matter of the invention can be explained from FIG. 1, in conjunction with FIG. 4. In all figures, identical parts have been given the same reference numerals, so that the explanations relate back essentially to these two figures.

On the center line of an ammunition body M (FIG. 1), there is a turbine/ignition pin unit 1 (FIG. 4), the impeller of the turbine being denoted by 1*a*, the release element, that is, the fuse tip, by 1*b* and the percussion needle by 1*d*. The shank of the unit 1 is screwed by means of a thread 1*c* into a threaded bushing 32 and is mounted with this bushing in the front part 4 of the ignition device so as to slide axially, opposite to the launching direction.

The impeller 1*a* is covered by a cap 2, which is of readily deformable construction in the manner of an impact cap. This cap has a central air inlet 3 of cylindrical construction to promote airflow, and lateral air outlets 52. The front part 4 of the ignition device is located behind the impeller 1*a*, with its front plate 53 in a rotatable, conical detonator cap 27.

Offset concentrically with respect to the ignition pin unit 1 is an arming mass 6, which engages by means of lugs 7 in the helical groove 9 of a tensioning shaft 8. On its front end, the tensioning shaft 8 has a groove 8*a*, which is used for mounting and adjusting the tensioning shaft 8. Furthermore, a locking mechanism 5 for the turbine 1 can be seen behind the tensioning shaft, the locking mechanism being inserted in the arming mass 6, see FIG. 2. The axial guideway for the cylindrical mass 6 is denoted by the reference numeral 6' and is in the form of an aperture in the front part 4. At its rear end, the tensioning shaft 8 terminates in a flattened coupling pin 10, Which engages in a rotor axle 11. A rotor 13 (FIG. 1) and a helically wound driving spring 12 are located on this axle 11. The rotor 13 is part of a so-called safety/arming unit (S+A) and at its top side is held in the housing 14 against a base plate 47 so as to rotate. A toothed wheel rim 13*a*, see FIGS. 9/10, is formed from a portion of the rotor circumference, and projects laterally from the otherwise cylindrical rotor 13. In the base plate 47 there is additionally an opening, which serves as catch 21 for securing the rotor 13.

The front part 4 is sealed by a ring seal 15 with respect to a top part 48 having a flange 48' and external screw thread 49, and contains the entire self-contained ignition system, which can accordingly be easily inserted in and removed from the ammunition body M. Other components of the ignition chain shown in FIGS. 1 and 4 include a transfer charge 43 in a casing 44, and an exchangeable (adaptable) booster charge 45 contained in a further casing 46 having a screw thread 50.

A protective cap 41 (FIG. 2) serves to protect the device against damage during transport and as a temporary safety device, indicating the safety-on or safety-off state. By means of an O-ring 16, the cap 41 seals the top part 48, and hence the ignition system as a whole, against dust and moisture. Opposing finger-grip parts 42 on the protective cap facilitate handling and enable the force required for a rotary movement and for applying bias to the seal 16 to be exerted, especially by hand.

Figure 6:
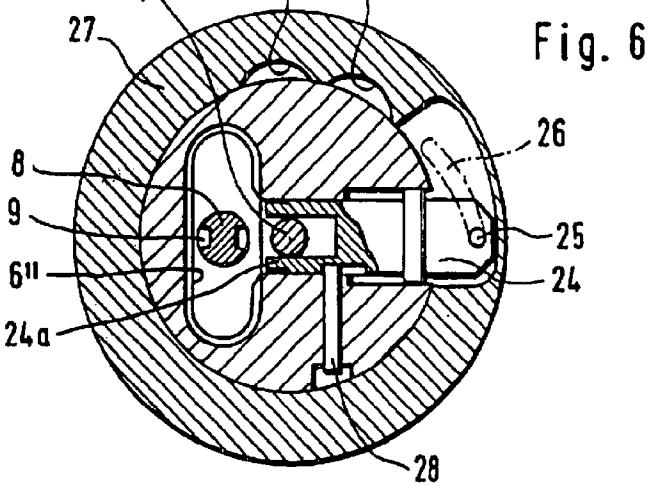
FIG. 6 is a view analogous to FIG. 5 through the plane of section VI—VI in FIG. 4.

A release lug 25 engages in the underside of the solid detonator cap 27; the release lug is on a displaceable fork-shaped arming mass catch 24 and is held in an end position by a stop pin 28, FIG. 6.

FIGS. 1 and 4 also show a so-called double-mass catch. This consists of an outer sleeve 18, with a helical spring 22 inserted therein, an inner sleeve 23, which simultaneously acts as secondary mass, a primary mass 19 having a further spring 20, and a mass ball catch 18*a*.

The sectional view of FIG. 2, looking along the line of section II—II in FIG. 1, shows the outer detonator cap 27 with an indicator window 34*c* and inner cambered recesses 34*a* and 34*b*. An indicator ball 33, acted on by a helical spring 35 that is supported at the end of a bore 33*a*, lies in the recess 34*a*.

Referring to FIG. 2, a ball catch 37 of a so-called rain-safety catch 36 engages in the threaded bushing 32. For that purpose, a helical spring 39 located on closure means 40 presses the ball catch 37 into a concave recess 38 in the threaded bushing 32.

FIG. 2 also shows the construction of the arming mass 6 with its two lateral lugs 7 and the indicated position of the locking mechanism 5, which engages with and secures the turbine impeller 1*a* above it.

The sectional view in FIG. 3 (line of section III—III) again shows the turbine/ignition pin unit 1 at the center. It is clamped in position by the two forks 24*a* of an arming mass catch 24, the displacement of which in turn is limited by the stop 28. The linear displacement required to release the locking position shown is effected by the release lug 25, which is guided in a curved release slot 26. The indicator ball 33 in the plane 11 has been omitted here for reasons of clarity.

In both FIGS. 2 and 3, the manual rotation to be effected is represented by an arrow marked D.

Figure 5:
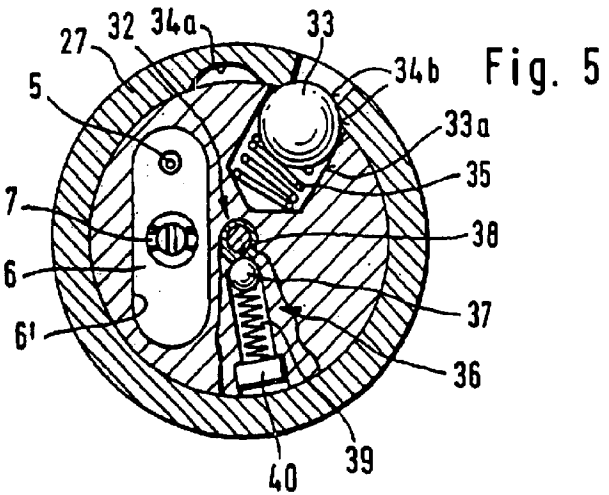
FIG. 5 is a view through the plane of section V—V of FIG. 4.

In the illustration according to FIG. 4 showing the ignition device in a ready-to-launch position, horizontal section lines V—V and VI—VI have been drawn in. The planes of the sections in plan view correspond to FIG. 5 and FIG. 6, respectively. FIG. 6 shows the released state of the arming mass catch 24.

Figures 7, 8:
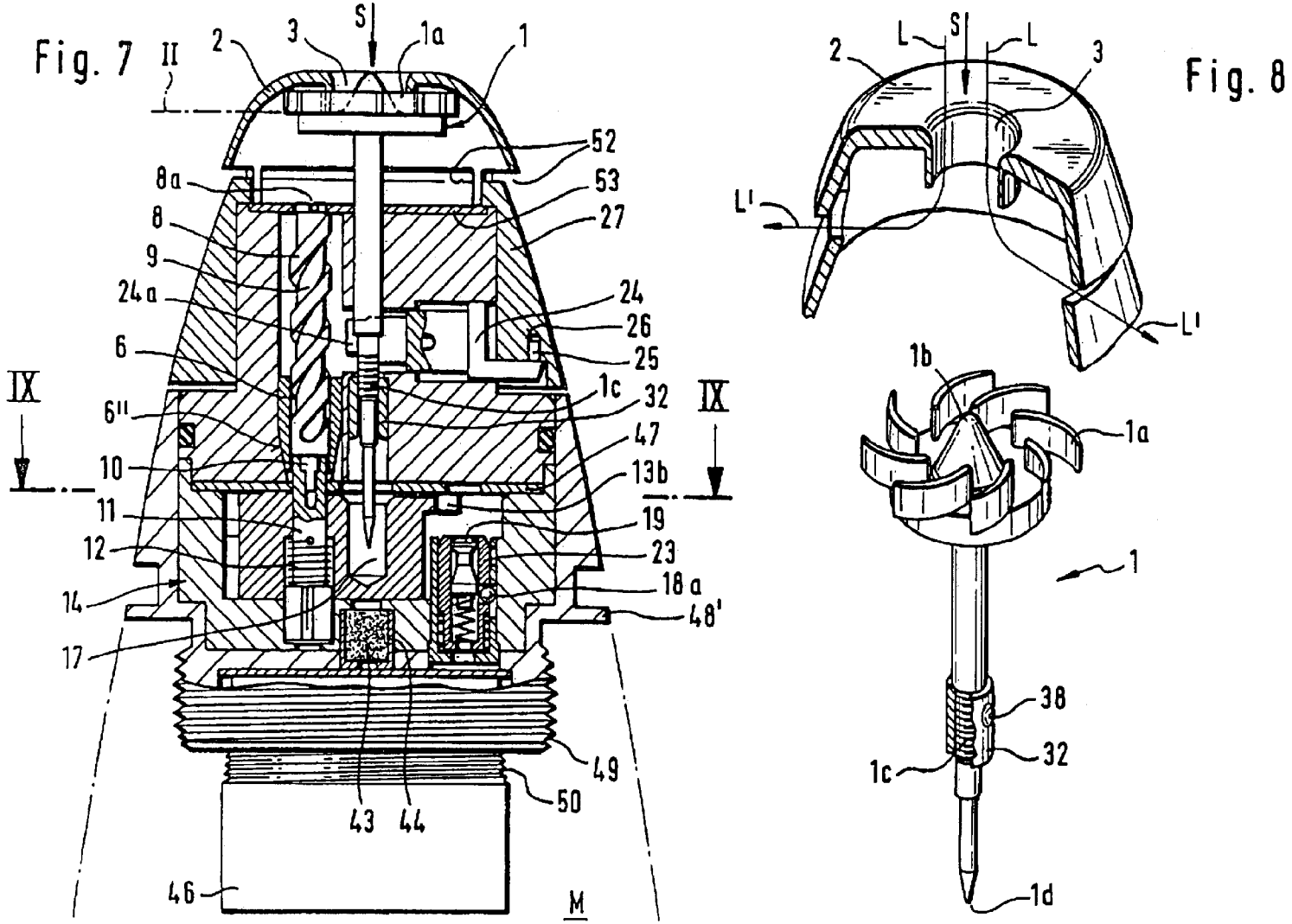
FIG. 7 shows the ignition device of FIG. 4 after launching in the armed setting.
FIG. 8 shows the construction of a cap of the ignition device of FIG. 1 with the airflow indicated, shortly after launching, and a complete view of the turbine/ignition pin unit arranged in the cap.

FIG. 7 shows the ignition device in a partially armed setting at start of post-barrel safety, that is, the impeller 1*a* of the turbine is fully extended in the launching direction and shuts off air intake to the inside of the cap 2 by positioning the solid central portion of impeller 1A against the inlet opening 3; the ram pressure S now acts in full on the projected area of the ignition device and the ammunition body M respectively. This state is distinguished by the position II of the impeller 1*a*. The fuse tip 1*b* can now act as an impact sensor.

The above-described function can be understood by reference to FIG. 8. This shows the air L flowing into the inlet opening 3 by virtue of the ram pressure S; the air, after flowing through and being rotated in the impeller 1*a* being marked L' and escaping laterally from the cap 2.

Figure 9:
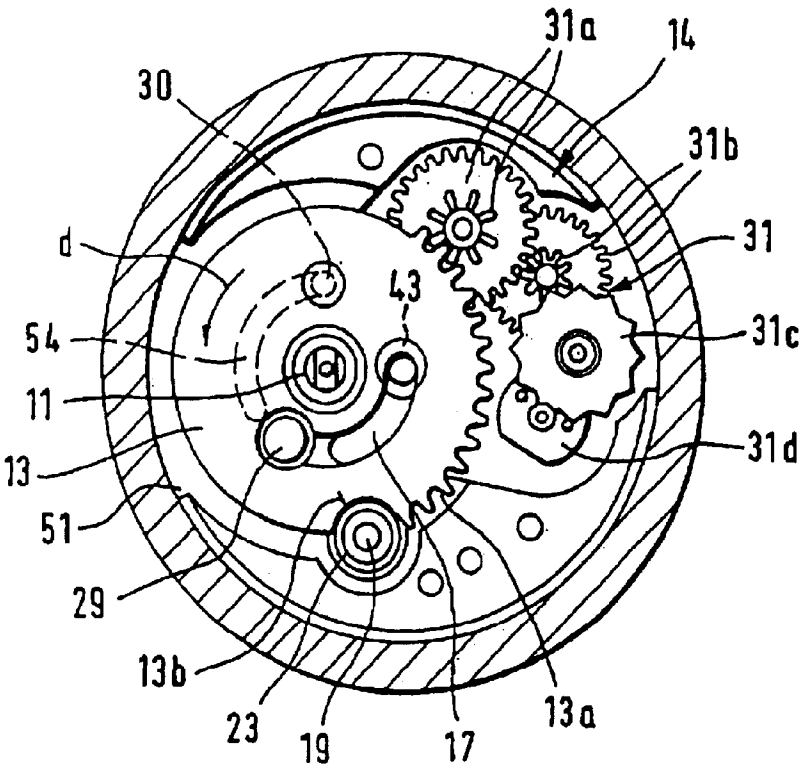
FIG. 9 is an illustration through the plane of section IX—IX of FIG. 7, at the start of post-barrel safety.

The arming mass 6, accelerated in a direction opposite to the launching direction, travels along the tensioning shaft 8 and turns the rotor 13, by way of the tensioning shaft 8, into the starting position shown in FIG. 9. At the same time, the helical spring 12, serving as driving spring for the rotor 13, is tensioned, and now exerts a torque on the rotor.

Figure 10:
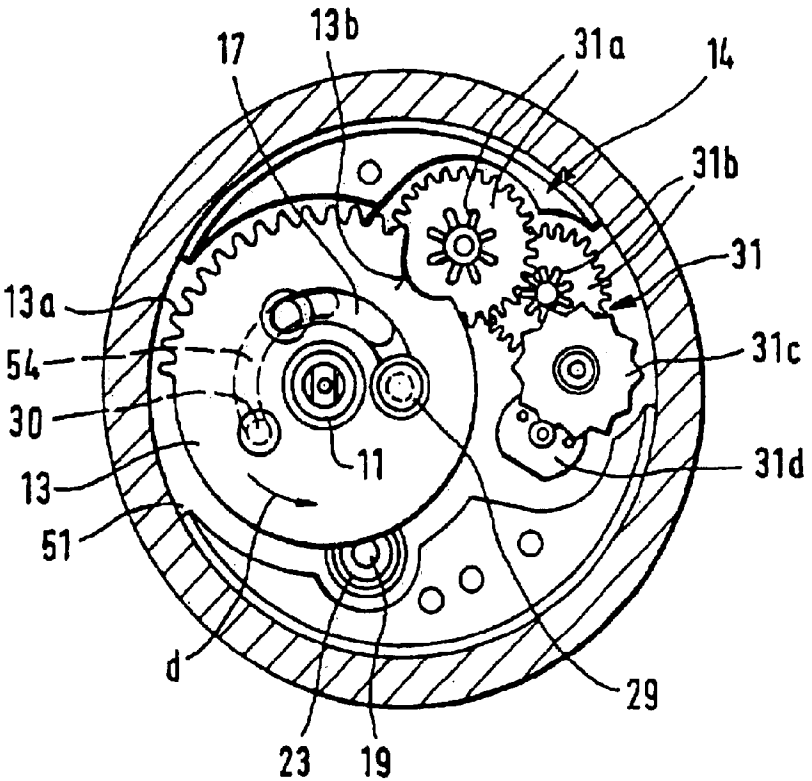
FIG. 10 is an illustration through the plane of section IX—IX of FIG. 7, after termination of post-barrel safety, that is, in the fully armed setting of the device.

FIGS. 9 and 10 illustrate the safety/arming unit 14 in sectional view along the line of intersection IX—IX in FIG. 7, FIG. 10 illustrating the unit 14 at the end of post-barrel safety.

A clock movement 31 can be seen, with a pair of primary gearwheels 31*a*, a secondary gearwheel 31*b*, and a Zappler drive 31*c* (escape wheel) with a Zappler element 31*d* (pallet). The upper primary gearwheel 31*a* engages with the teeth of the toothed wheel rim 13*a*. The rotor 13 is arranged so as to rotate through 120° about the axle 11 and, with its annular groove 17, which is closed at the bottom, covers the transfer charge 43; compare FIG. 7. This also shows the helical spring 12 acting on the rotor axle 11 and which exerts a torque on the rotor in the direction of rotation d. A rear annular groove 54 can be observed through a bore 30 and thus the rotated position of the rotor 13 can be monitored. In the safety-on position, the percussion detonator charge 29 is rotated through 120° with respect to the axis of the percussion needle 1*d* (FIG. 4). The launch pulse has caused the primary mass 19 to slide backwards from its starting position I, see FIG. 4, and after rotation of the rotor 13 the primary mass 19 engages in the recess 13*b*.

FIG. 8 shows the construction of the cap 2 with the airflow to the turbine/ignition pin unit 1; also shown in the threaded bushing 32 is the concave recess 38, in which the ball 37 (see FIG. 5) engages and which provides rain security. This arrangement increases the mechanical resistance to displacement of the bushing 32 by a value determinable by the spring characteristic, that is, it compensates for the increased ram pressure occurring during rain or snow. The turbine/ignition pin unit 1 cannot therefore initiate ignition prematurely, that is, during flight of the ammunition body M to its target.

The method of functioning of the ignition device and its manipulation are as follows:

The ignition device (FIG. 1) is screwed in a manner known per se using the thread 49 into the ammunition body M to be prepared for use. It can in particular easily be adapted by means of the booster charge 45, which is also exchangeable, to the pyrotechnical characteristics of the ignition chain, and can therefore be used for different types of ammunition.

Before use in a gun barrel, the protective cap 41 is removed from the ignition device by manual rotation at the finger-grip part 42 through 35°. At the same time, the arming mass catch 24 is moved out of its clamping position (FIG. 3) by means of the release lug 25 and the curved release slot 26, so that the impeller of the turbine 1*a* is blocked only by the locking mechanism 5. The two fork ends 24*a* of arming mass catch 24 unblock the path in the aperture 6', so that the path is able to act as a guideway for the arming mass 6. At the same time, the indicator ball 33, which may be marked with red, is transferred from its position in recess 34*a* into recess 34*b*, so that it is now clearly visible in the window 34*c*. This produces and indicates a ready-to-launch state.

When a normal launch of the ammunition body M from the barrel occurs, the primary mass 19, together with its casing 23 and the springs 20 and 22, moves, by virtue of its inertial behavior, out of the protected position (FIG. 1, FIG. 9) in recess 13*b* in the rotor 13. The further arming mass 6 can now move in the guideway 6' along the helical groove 9 and thus turns the tensioning shaft 8 and the rotor 13 mounted thereon. The arming mass 6 is intercepted on its acceleration path by intercepting cone 6" and is positioned there during the further regular flight path of the ammunition body M. Only by this rotation of the rotor is the driving spring 12 tensioned and is able to set the clock movement 14 of the safety/arming unit in motion, a Zappel mechanism known per se, which determines post-barrel safety.

At the start of the resulting rotation of the tensioning shaft 8 on movement of the arming mass 6, the locking mechanism 5 is also disengaged and releases the turbine 1*a*. The ram pressure S, acting through the air inlet 3, moves the turbine 1*a* clockwise, so that the turbine/ignition pin unit 1 "screws upwards" into the upper position (FIG. 7) and shuts off further airflow through the air inlet and turbine.

The driving spring 12 turns the rotor in direction d (FIG. 9) and, with a delay by the Zappel mechanism during the interval of post-barrel safety, for example 2.3 sec, into the position shown in FIG. 10. The percussion detonator charge 29 is consequently displaced to a position above the transfer charge 43, so that the fuse is now in a fully armed setting.

It is possible to reproduce post-barrel safety within a time interval of a few tenths of a second, even in the case of several ignition devices.

Figure 11:
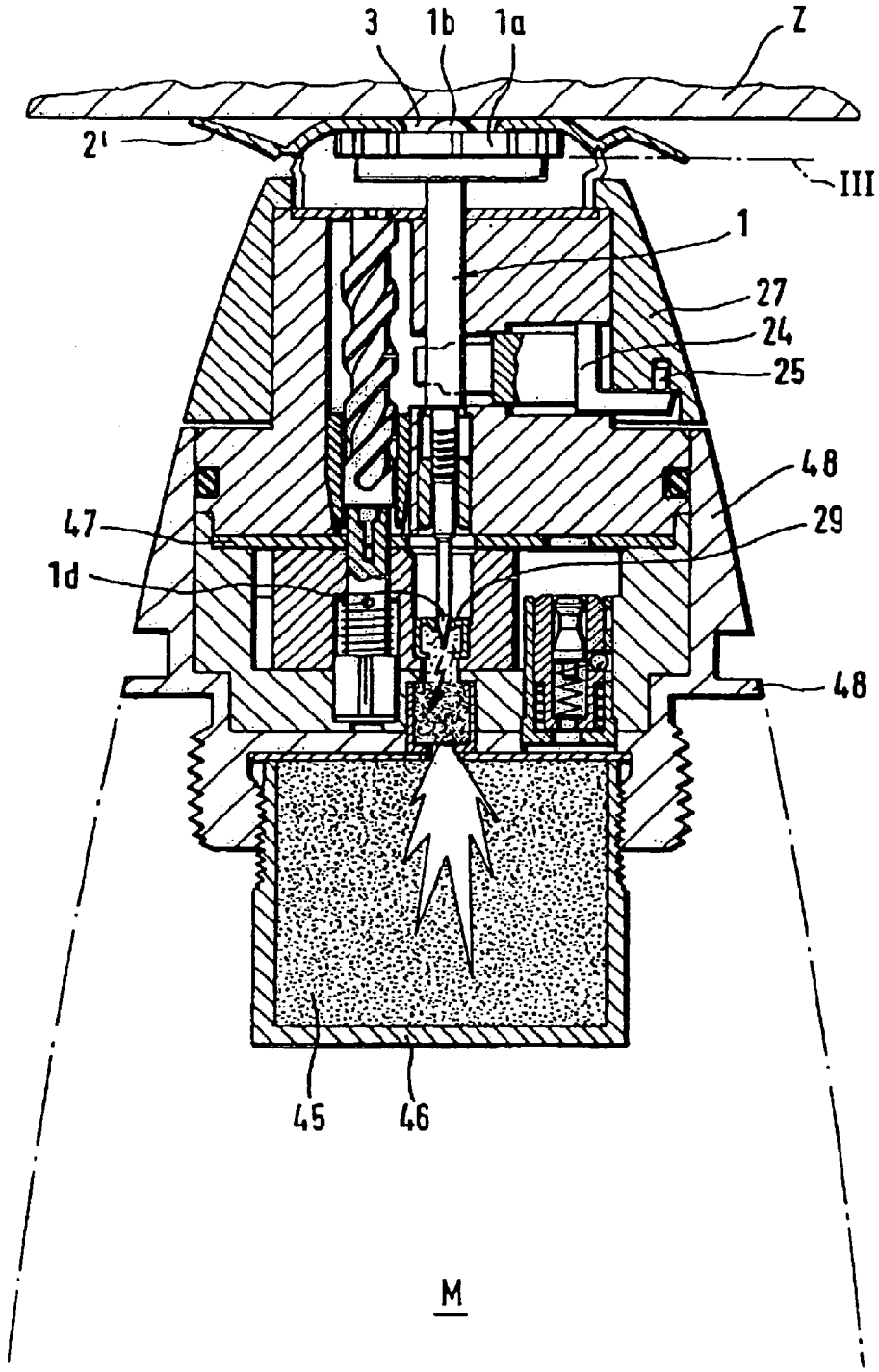
FIG. 11 shows the ignition device at impact on a target with the percussion pin driven into the primary detonator.

If the fuse tip 1*b* now impacts on a target Z, see FIG. 11, the opposite end of the turbine/ignition pin unit 1, namely percussion needle 1*d*, drives into the percussion detonator charge 29 and initiates it, which triggers the ignition chain, as illustrated in FIG. 11.

From FIG. 11 it is also clear that the cap 2 is of easily deformable construction, so that even in the case of soft targets Z it immediately assumes the form 2' illustrated and transfers the impact force to the entire turbine/ignition pin unit 1. Such power transfer insures operation, especially in the case of ammunition bodies that have hit the target at an angle. It is also especially reliable in the case of water surface contact.

The ignition device illustrated by way of example has a high degree of safety and can easily be adapted by the skilled person to specific conditions, such as launching characteristics etc. The modular construction, especially of the ignition chain, also enables the device to be adapted without difficulty to different calibers.

The exemplary embodiment is largely insensitive to shocks and is proofed against being dropped; the engaged arming mass catch 24 prevents not only an undesirable movement of the arming mass 6, but also at the same time blocks the turbine/ignition pin unit 1 by the clamping action of the forks 24*a*.

If the launching acceleration is insufficient, then the primary mass 19, in the form of a two-stage catch, stops the rotor 13 by re-engaging in the recess 13*b* thereof (see FIG. 9). Requiring a correct progression of acceleration, the driving spring 12 is likewise blocked before the clock mechanism 14 determining the actual post-barrel safety can even be set in operation.

The ignition chain comprising the percussion needle 1*d* and the charges 29, 43 and 45 functions only when the exactly prescribed geometry is adhered to, which in turn is possible only when all launching parameters co-ordinated to that end are met.

At impact on the target Z, very rapid initiation is effected, the threaded bushing 32 being mounted in the front part 4 so as to be displaceable against the direction of launching so that there can be a direct pulse transfer from the tip 1*a* to the percussion needle 1*d*. In this connection, the whole turbine/ignition pin unit 1 is mounted so that it is secure against buckling and, with the large transfer area provided by the deformed cap 2' (FIG. 11) and the impeller 1, can achieve the required displacement path even in the case of extremely acute-angled hits.

It appears that when the ignition device hits the surface of water, the cavity between the inlet opening 3 of the cap and the impeller 1*a* acts like a hydropneumatic spring, which increases the reliability that ignition will be initiated and even shortens the initiation interval compared with solid targets. The impact force necessary to initiate ignition can be predetermined or set by a simple selection of the spring 39, see FIG. 5.

Surprisingly, the ignition device also works on snow cover, which action is likewise attributable to hydrodynamic effects and has not previously been observed with conventional percussion fuses.

Applying the subject matter of the invention to an electronic ignition device permits substantial miniaturization of the whole. At the same time, the safety functions can be monitored digitally (by means of microprocessors), so that complete microprocessor-control of the arming of the ignition device can be accomplished.

We claim:

1. A method for protecting and arming a mechanical percussion fuse in a projectile having safety devices operating physically independently of one another and having a linearly displaceable striking pin or ignition pin having an electrical ignition contact, characterized in that, during launching, inertia of a mass releases a ram pressure responsive element, the striking pin or ignition pin is displaced relative to the projectile by and opposite to a ram pressure acting on the and a pressure-responsive element from a first, protected position at a rear viewed in a launching direction into a second, armed position at a front; an initiation charge is moved into a position directly rearward of the striking pin or ignition pin; and in that, on impact of the projectile, the striking pin or ignition pin initiates an ignition process by rearward displacement into a third position beyond the second position engaging the initiation charge.

2. The method according to claim 1, further characterized In that the ram pressure responsive element comprises an impeller and in that a rotation of the impeller is converted into a linear movement that displaces the striking pin or ignition pin to the second, armed position.

3. A device for securing and arming a mechanical impact fuse in a projectile having safety devices acting physically independently of one another and having a linearly displaceable striking pin or ignition pin having an electrical ignition contact wherein post-barrel safety is controlled by a turning rotor delayed by means of a clock mechanism, characterized in that at a head of the projectile there is provided an inlet opening for ram pressure, in that behind the inlet opening there is provided an impeller that is fixed to a front end of the striking pin or ignition pin, in that the striking pin or ignition pin has a screw thread on a shank and in that the thread is inserted in a screw thread of a threaded bushing and the turning rotor has an initiation charge rotatable into a position aligned with the striking pin or ignition pin when in a front position, such that the ram pressure acting on the impeller displaces the striking pin or ignition pin from a first, rear position into the front position, so that on impact of the projectile the striking pin or ignition pin initiates an ignition process by rearward displacement into a third position extending beyond the second position and engaging the initiation charge.

4. The device according to claim 3, further characterized in that the impeller includes means for closing the inlet opening when the impeller is in a front position.

5. The device according to claim 3 further including means for displacing the threaded bushing opposite to a launching direction of the projectile upon impact.

6. The device according to claim 3, further characterized in that a double mass catch is provided, to engage a rotor to determine post-barrel safety, and in that the catch releases the rotor for rotation only after reaching a predetermined degree of acceleration.

7. The device according to claim 3, further characterized in that on a tensioning shaft having a helical groove there is mounted an arming mass having lugs engaging in the helical groove, and in that the tensioning shaft rotating through the arming mass on launch of the projectile brings the rotor into an armed position during a predetermined acceleration interval.

8. The device according to claim 7, further characterized in that the tensioning shaft tensions a driving spring that loads a rotor with a torque.

9. The device according to claim 7, characterized in that a locking device is located on the arming mass, which locking device engages in the impeller and blocks the impeller prior to launching and by movement releases the impeller on launching.

10. The device according to claim 3, further characterized in that a protective cap is provided, which engages a front part of the ignition device and allows the front part to rotate.

11. The device according to claim 10, further characterized in that a release lug that radially displaces an arming mass catch projects into the front part.

12. The device according to claim 11, characterized in that the arming mass catch comprises two forks which, when the protective cap is in place and secured, partially engage in the displacement path of the arming mass and at the a same time axially block a turbine/ignition pin unit.

13. The device according to claim 5, further characterized in that a spring-loaded ball acts on the threaded bushing to increase the a resistance of the bushing to displacement.

14. The device according to claim 13, characterized in that the ball is located in a concave recess let into the threaded bushing.

* * * * *